US008499586B1

(12) United States Patent
Adam

(10) Patent No.: US 8,499,586 B1
(45) Date of Patent: Aug. 6, 2013

(54) ERGONOMIC CROCHET HOOK

(76) Inventor: Lindsay Jean-Marie Adam, Akron, OH (US)

( * ) Notice: Subject to any disclaimer, the term of this patent is extended or adjusted under 35 U.S.C. 154(b) by 0 days.

(21) Appl. No.: 13/371,448

(22) Filed: Feb. 12, 2012

(51) Int. Cl.
*D04B 3/02* (2006.01)

(52) U.S. Cl.
USPC ..... 66/118

(58) Field of Classification Search
USPC ..... 66/1 A, 117, 118
See application file for complete search history.

(56) References Cited

U.S. PATENT DOCUMENTS

| | | | | | |
|---|---|---|---|---|---|
| 1,192,623 | A | * | 7/1916 | Hallett | 66/118 |
| 1,208,958 | A | * | 12/1916 | Hawkins | 66/118 |
| 1,347,027 | A | * | 7/1920 | Green | 66/118 |
| 1,355,878 | A | * | 10/1920 | Akin | 66/118 |
| 1,358,067 | A | * | 11/1920 | Ensfield | 66/118 |
| 1,376,151 | A | * | 4/1921 | Mitchell | 66/118 |
| 1,409,579 | A | * | 3/1922 | Riker | 66/118 |
| 1,409,580 | A | * | 3/1922 | Riker | 66/118 |
| 1,409,581 | A | * | 3/1922 | Riker | 66/118 |
| 1,415,472 | A | * | 5/1922 | Puc | 66/118 |
| 1,502,584 | A | * | 7/1924 | Perry | 66/118 |
| 1,751,796 | A | * | 3/1930 | Denner | 223/102 |
| 2,279,662 | A | * | 4/1942 | Denner | 223/102 |
| 2,309,528 | A | * | 1/1943 | Otting et al. | 66/117 |
| 2,404,855 | A | * | 7/1946 | Marshall | 66/117 |
| 2,440,413 | A | * | 4/1948 | Mock | 66/118 |
| 2,462,473 | A | * | 2/1949 | Delaney | 66/117 |
| 2,507,174 | A | * | 5/1950 | Phillips | 66/118 |
| 2,601,769 | A | * | 7/1952 | Visconti | 66/118 |
| 2,608,077 | A | * | 8/1952 | Suessman | 66/118 |
| 3,228,212 | A | * | 1/1966 | Huber | 66/117 |
| 3,327,498 | A | * | 6/1967 | Matthews | 66/121 |
| 3,442,235 | A | * | 5/1969 | Gibson | 112/169 |
| 3,808,840 | A | * | 5/1974 | Blezard et al. | 66/87 |
| 3,893,603 | A | * | 7/1975 | Rush | 223/104 |
| 4,047,397 | A | * | 9/1977 | Laliberte | 66/118 |
| 4,607,505 | A | | 8/1986 | Dunker et al. | |
| 4,846,351 | A | * | 7/1989 | Gardiner | 206/574 |
| 6,668,597 | B2 | | 12/2003 | Robinson | |
| 7,114,354 | B1 | | 10/2006 | Dremman | |
| D548,453 | S | | 8/2007 | Mihara | |
| 7,578,147 | B2 | | 8/2009 | Feldman-Abovitz | |
| 7,874,181 | B1 | * | 1/2011 | Lindahl | 66/117 |
| 7,874,182 | B1 | * | 1/2011 | Lindahl | 66/118 |
| 2007/0076409 | A1 | | 4/2007 | Boesch et al. | |

* cited by examiner

*Primary Examiner* — Danny Worrell
(74) *Attorney, Agent, or Firm* — Hahn, Loeser & Parks, LLP

(57) ABSTRACT

One or more ergonomic crochet devices are provided herein. A crochet device may comprise a curved elongated shaft and/or a grip anchor. The curved elongated shaft may be configured to provide a depressed resting angle of the crochet device when held by the user at rest. The depressed resting angle may result in a hook of the curved elongated shaft being positioned at a lower position than conventional crochet devices when held at rest. In this way, reduced wrist flexing may be used to lower the hook into a crocheting angle and/or maintain the hook at the crocheting angle during crocheting activity. The grip anchor may be configured to create a pivot point of the crochet device near the grip anchor. In this way, small wrist motion may translate into large positional change of the hook in order to easily rotate and/or manipulate the crochet device during crocheting activity.

10 Claims, 5 Drawing Sheets

ERGONOMIC CROCHET HOOK

BACKGROUND

Crocheting is the process of creating fabric by pulling loops of material through other loops. Crocheting may be performed using a hand-held device, such as a crochet device. Conventional crochet devices may comprise an elongated shaft (e.g., a cylindrical straight shaft) connected to a hook used during crocheting to manipulate material, such as yarn, to create fabric. During crocheting, a user may grip the elongated shaft using an overhand knife grip, an underhand pencil grip, or other grips. The overhand knife grip may require substantial wrist motion (e.g., flexing of the wrist) in order to maneuver the crochet device during crocheting. The underhand pencil grip may require finger pressure to securely grip the crochet device and wrist motion to maneuver the crochet device during crocheting. Unfortunately, the overhand knife grip, the underhand pencil grip, and/or other grips used to maneuver conventional crochet devices may result in uncomfortable pressure points (e.g., finger tip pressure used to grip the crochet device), wrist and finger fatigue, and diminished blood circulation because conventional crochet devices must be securely held in a user's hand for rotation and/or other manipulations of the hook during crocheting. For example, continual finger pressure and substantial wrist flexing may be required so that the hook of the crochet device may draw a new loop through an existing loop during crocheting.

Many current solutions may provide inadequate ergonomic benefits that may not relieve finger pressure and/or reduce wrist flexing. For example, the elongated shaft may comprise a flattened thumb grip that may be gripped by the user during crocheting. The flattened thumb grip may place the hand of the user in an advantageous orientation relative to the hook during crocheting for easy rotation when creating new loops. However, hand stiffness and/or injury may result from repetitive crocheting motion because the hand position and the finger grip are at a fixed position dictated by the location of the flattened thumb grip. Accordingly, it may be advantageous to provide a crochet device that reduces finger pressure and/or wrist motion.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Among other things, one or more crochet devices configured for ergonomic crocheting are disclosed herein. In particular, finger pressure and/or wrist motion may be reduced during crocheting based upon the various crochet device configurations that are disclosed. In one example of a crochet device, the crochet device may comprise a shaft. It may be appreciated that a wide variety of shapes, contours, diameters, and/or configurations are contemplated for the shaft (e.g., a cylindrical shaft, a curved elongated shaft, and/or a plethora of other shapes/configurations), and that the shaft may be comprised of various materials, such as wood, plastic, metal, and/or other materials suitable for a crochet device. The shaft may comprise a hook end coupled to a hook (e.g., a hook configured for manipulating material during crocheting to form loops, stitches, patterns, or the like from the material).

The shaft may comprise a base end coupled to a grip anchor, which may be configured to reduce finger pressure and/or wrist motion. In particular, the grip anchor may comprise a curved portion configured to provide support for a first anchor finger of a user (e.g., the user may securely place a middle finger and/or any other finger against the curved portion). In one example, the grip anchor may comprise a backside portion configured to provide support for a second anchor finger of the user (e.g., the user may place a ring finger and/or any other finger against the backside portion). In this way, the first anchor finger and/or the second anchor finger may control the crochet device at the grip anchor using a relaxed grip (e.g., a middle finger and a ring finger may securely hold the grip anchor between one another with reduced finger pressure, which may create a pivot point near the grip anchor that may be used to control the crochet device). The grip anchor may be configured to create a pivot point for the crochet device near the grip anchor (e.g., near the base end of the shaft). Because the pivot point may be created near the grip anchor, the user may maneuver the crochet device with reduced wrist motion (e.g., small wrist motion may translate into large positional change of the hook for crocheting) as compared with conventional crochet devices. Additionally, finger pressure may be relieved because the first anchor finger and/or the second anchor finger may gently rest against the grip anchor, while creating a secure grip (e.g., as opposed to a secure grip created from finger tip pressure used in conventional crochet devices).

In another example of a crochet device, the crochet device may comprise a curved elongated shaft. The curved elongated shaft may comprise a hook end coupled to a hook (e.g., a hook configured for manipulating material during crocheting to form loops, stitches, patterns, or the like from the material). The curved elongated shaft may comprise a base end configured to create a pivot point between a palm of a user and a first anchor finger of the user. For example, the palm of the user may rest on a top portion of the base end, while the first anchor finger (e.g., and/or other anchor fingers) may rest on a bottom portion of the base end, thus securing the crochet device between the palm and the anchor finger and/or creating the pivot point near the base end. Finger pressure may be relieved because the crochet device may be gently secured between the palm and the first anchor finger (e.g., the crochet device may be securely held and/or maneuvered with little to no finger tip pressure that may otherwise result in discomfort).

The curved elongated shaft may comprise a curvature (e.g., a curvature comprising an elevation change from the hook end to the base end between about 0.5 inches and 2 inches, for example). The curvature may be configured to provide a depressed resting angle of the crochet device when held by the user at rest. That is, the resting angle of the crochet device may be depressed/smaller (e.g., the hook may be held at a lower position/angle than conventional crochet devices when held at rest) because the curvature lowers the position/angle of the hook relative to the pivot point when held at rest by the user. In this way, reduced wrist flexing may be used to lower the hook of the crochet device into a crocheting angle used during crocheting activity (e.g., in contrast to conventional crochet devices lacking a curved elongated shaft that may required substantial wrist flexing to lower the hook from a non-depressed resting angle to the crocheting angle).

In another example of a crochet device, the crochet device may comprise a curved elongated shaft comprising a hook end coupled to a hook, a base end coupled to a grip anchor, and a curvature configured to provide a depressed resting angle of the crochet device when held by the user at rest. The grip anchor may comprise a curved portion configured to provide support for a first anchor finger of a user and/or a backside portion configured to provide support for a second anchor finger of the user. The grip anchor may be configured to create a pivot point of the crochet device near the grip anchor (e.g., near the base end of the curved elongated shaft based upon support provided by the first and/or second anchor fingers). The crochet device may be maneuvered from the pivot point during crocheting using reduced wrist motion and/or finger pressure. Additionally, wrist flexing used to move the hook from a resting position (e.g., the depressed resting angle) to a crocheting position (e.g., a crocheting angle) may be reduced because of the depressed resting angle created by the curvature of the curved elongated shaft. In this way, the grip anchor and/or the curved elongated shaft may relieve finger pressure and/or reduce wrist motion that may otherwise result in fatigue, hand stiffness, diminished blood circulation, and/or pain.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings. The description herein provides preferred embodiments of the present invention crochet device, but should not be construed as limiting its scope. For example, variations in diameter, length, curvature, material, and/or other variations than those shown and described herein, may be incorporated into the present invention. Thus, the scope of the present invention should be determined by the appended claims and their legal equivalents, rather than being limited to the examples given.

DETAILED DESCRIPTION

Figure 1A:
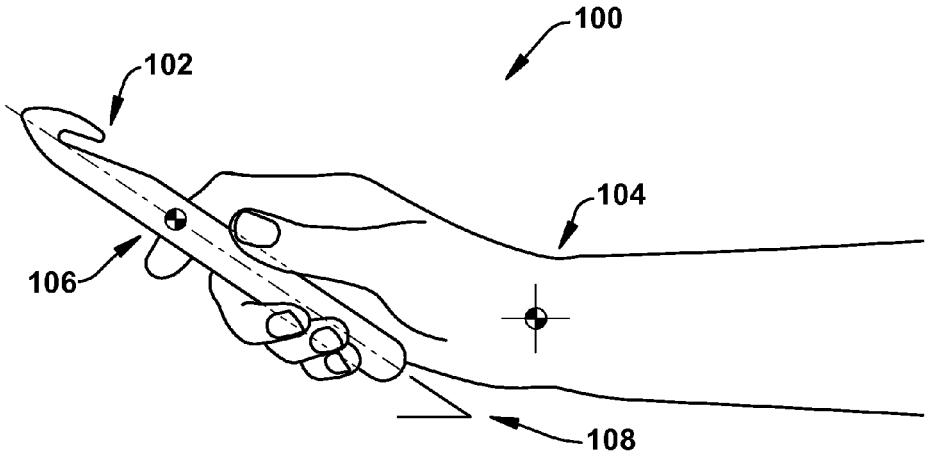
Fig. 1A (Prior Art)
FIG. 1A is an illustration of an example of a prior art crochet device held at a resting angle.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are illustrated in block diagram form in order to facilitate describing the claimed subject matter.

Crocheting material into fabric using a crochet device may require numerous hours of repetitive crocheting motion. For example, a user may grip the crochet device using finger pressure to create a pivot point near a hook end of the crochet device. In this way, the user may rotate, maneuver, and/or manipulate the crochet device from the pivot point using various wrist motions during crocheting. Unfortunately, hand discomfort, fatigue, stiffness, and/or pain may result from using conventional crochet devices due to the finger pressure and/or the wrist motions.

Accordingly, one or more ergonomic crochet devices used for crocheting activity are provided herein. A crochet device may comprise a curved elongated shaft and/or a grip anchor. The curved elongated shaft may comprise a curvature configured to provide a depressed resting angle of the crochet device when held by the user at rest. The depressed resting angle may result in a hook of the curved elongated shaft being positioned at a lower position/angle than conventional crochet devices when held at rest. In this way, reduced wrist flexing may be used to lower the hook into a crocheting angle used during crocheting activity. The grip anchor may be configured to create a pivot point of the crochet device near the grip anchor. For example, a first anchor finger and/or a second anchor finger may be used to secure the grip anchor to create the pivot point. In this way, small wrist motion may translate into large positional change of the hook in order to easily rotate and/or maneuver the crochet device during crocheting activity.

FIG. 1A illustrates an example 100 of a prior art crochet device 102 held at a resting angle 108. The prior art crochet device 102 may comprise a shaft with a hook end coupled to a hook used for crocheting. A user may grip the prior art crochet device 102 by applying finger pressure to the shaft. For example, the user may apply pressure with a thumb, an index finger, and/or a middle finger near the hook end of the prior art crochet device 102. In this way, a pivot point 106 may be created near the hook end of the prior art crochet device 102. While holding the prior art crochet device 102 at rest, a wrist of the user may be in a neutral position 104, which may result in the large resting angle 108 for the prior art crochet device 102 (e.g., a 40 degree or more difference between the resting angle 108 and a crocheting angle (e.g., crocheting angle 118 of FIG. 1B) may result). Because of the large resting angle 108, the hook may be held at a high position/angle from a crocheting position/angle in which the hook is to be placed during crocheting. Accordingly, substantial wrist motion may be required to maneuver the hook of the prior art crochet device 102 from the resting position/angle into the crocheting position/angle in order to perform crocheting activity (e.g., continuous wrist flexing may be needed to keep the hook angled at the crocheting position/angle during crocheting activity). Additionally, because the pivot point 106 is created near the hook end of the shaft, significant finger pressure may be used to secure the grip on the prior art crochet device 102 when rotating, maneuvering, and/or manipulating the prior art crochet device 102. Such wrist motion and/or finger pressure may result in hand fatigue, hand stiffness, diminished blood circulation, and/or pain.

Figure 1B:
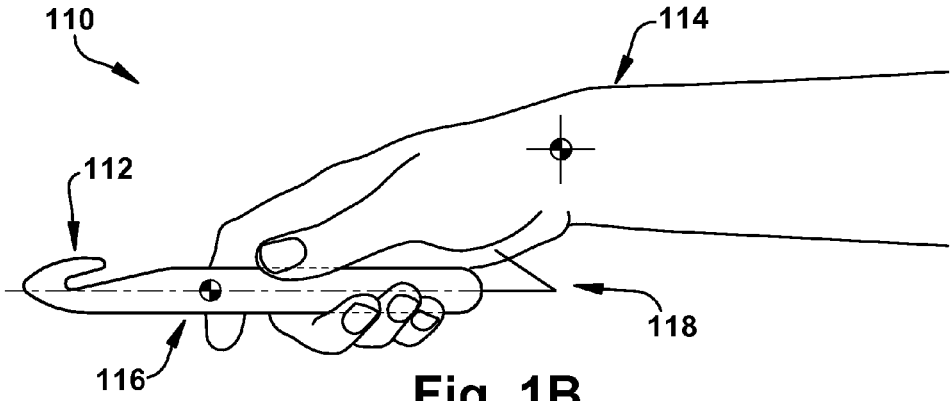
Fig. 1B (Prior Art)
FIG. 1B is an illustration of an example of a prior art crochet device held at a crocheting angle.

FIG. 1B illustrates an example 110 of a prior art crochet device 112 held at a crocheting angle 118 during crocheting activity. The prior art crochet device 112 may comprise a shaft with a hook end coupled to a hook used for crocheting. A user may grip the prior art crochet device 112 by applying finger pressure to the shaft (e.g., near the hook end of the shaft). Such a grip may create a pivot point 116 near the hook end of the prior art crochet device 112. In order to maneuver the prior art crochet device 112 into the crochet angle 118 for crocheting activity (e.g., from a resting angle 108 illustrated in example 100 of FIG. 1A), the user may significantly flex a wrist into a flexed position 114 because such wrist flexing may be required to lower the hook from a resting angle into the crocheting angle 118 and/or maintain the hook at the crocheting angle 118 during crocheting activity (e.g., a 40 degree or more change in angle of the prior art crochet device 112). Similarly, significant finger pressure and/or wrist motion may be needed to rotate, maneuver, and/or manipulate the prior art crochet device 112 because the pivot point 116 is near the hook end of the shaft (e.g., large wrist motion may translate into small change in position of the hook due to the location of the pivot point 116).

Figure 2A:
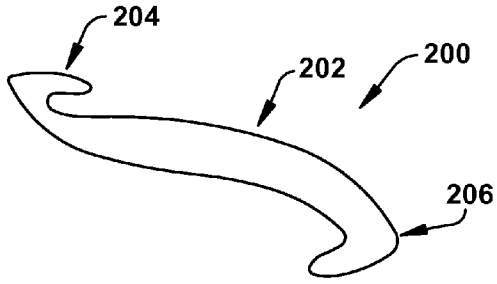
FIG. 2A is an illustration of an example of a crochet device comprising a curved elongated shaft and/or a grip anchor.
Figure 2B:
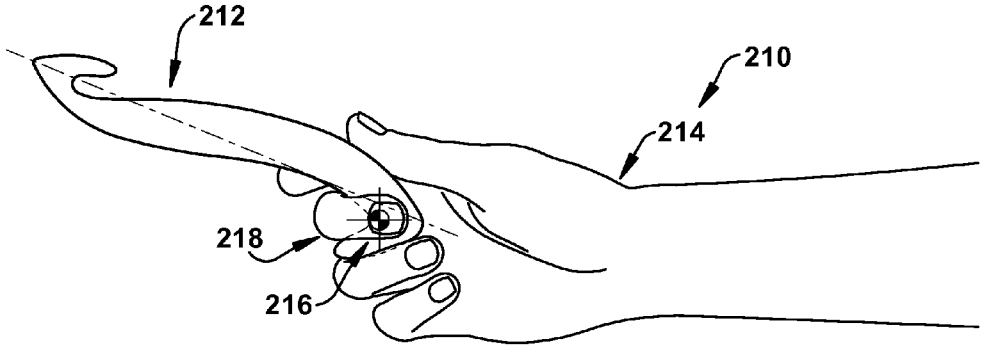
FIG. 2B is an illustration of an example of a crochet device comprising a curved elongated shaft and/or a grip anchor, the crochet device held at a depressed resting angle.
Figure 2C:
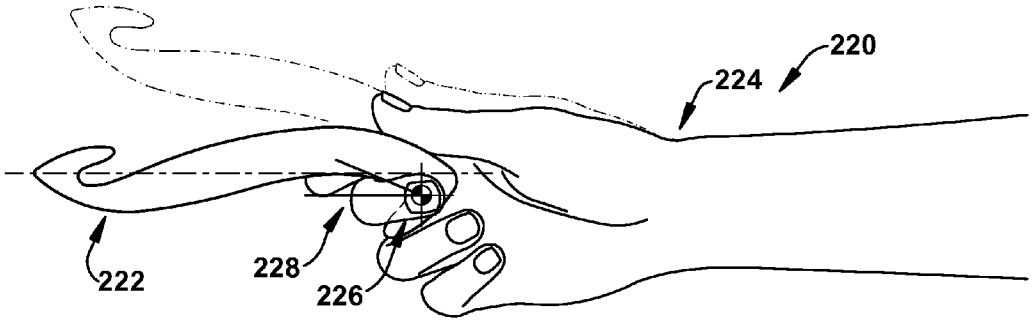
FIG. 2C is an illustration of an example of a crochet device comprising a curved elongated shaft and/or a grip anchor, the crochet device held at a crocheting angle.

FIG. 2A illustrates an example 200 of a crochet device. The crochet device may comprise a curved elongated shaft 202. The curved elongated shaft 202 may comprise a hook end coupled to a hook 204 used for crocheting material. The curved elongated shaft 202 may comprise abase end coupled to a grip anchor 206. The curved elongated shaft 202 may comprise a curvature (e.g., a curvature comprising an elevation change from the hook end to the base end between about 0.5 inches and 2 inches) configured to provide a low pressure resting position for fingers (e.g., non-anchor figures) of the user during crocheting activity. The curvature may be configured to provide a depressed resting angle for the crochet device (e.g., a depressed resting angle smaller than a resting angle of a conventional crochet device). For example, the depressed resting angle may comprise a 0 to 20 degree angle between the depressed resting angle of the crochet device when held by the user at rest and a crocheting angle of the crochet device when held by the user during crocheting activity (e.g., crochet device 212 held at the depressed resting angle as illustrated in FIG. 2B and crochet device 222 held at the crocheting angle as illustrated in FIG. 2C). It may be appreciated that the depressed resting angle is not limited to 0 to 20 degrees, and that other depressed resting angles are contemplated herein. The depressed resting angle may position the hook 204 at a depressed position/angle so that reduced wrist motion may be used to lower the hook 204 into the crocheting angle during crocheting activity (e.g., small wrist motion may translation into large positional change of the hook 204).

In one example, the grip anchor 206 may extend at least half an inch from the base end of the curved elongated shaft 202. It may be appreciated that the grip anchor 206 is not limited to extending at least half an inch from the base end, and that other lengths are contemplated herein (e.g., the grip anchor 206 may extend at least far enough to provide support for a first anchor finger of the user). The grip anchor 206 may comprise a curved portion configured to provide support for a first anchor finger of the user (e.g., a middle finger and/or any other finger of the user). The grip anchor 206 may comprise a backside portion configured to provide support for a second anchor finger of the user (e.g., a ring finger and/or any other finger of the user). In this way, the grip anchor 206 may be configured to create a pivot point for the crochet device near the grip anchor 206. In one example, the grip anchor 206 may be configured to pivot the crochet device at the pivot point based upon support provided by the first anchor finger of the user against the curved portion of the grip anchor 206. In another example, the grip anchor 206 may be configured to pivot the crochet device at the pivot point based upon additional support provided by the second anchor finger of the user against the backside portion of the grip anchor 206. The crochet device may be held using the first anchor finger and/or second anchor finger with reduced finger pressure (e.g., reduced finger pressure may be used to control the crochet device in comparison with finger pressure and/or finger tip pressure used to secure conventional crochet devices). In this way, the crochet device may be controlled and/or maneuvered using a relaxed grip. Reduced wrist motion may be used to maneuver the crochet device because the pivot point is near the grip anchor 206 (e.g., small wrist motion may translate into large positional change of the hook 204 in comparison with conventional crochet devices).

FIG. 2B illustrates an example 210 of a crochet device 212 held at a depressed resting angle 218. The crochet device 212 may be held at the depressed resting angle 218 while a wrist of a user is held in a resting position 214. The crochet device 212 may comprise a curved elongated shaft. The curved elongated shaft may comprise a hook end coupled to a hook used for crocheting material. The curved elongated shaft may comprise a base end coupled to a grip anchor. The curved elongated shaft may comprise a curvature configured to provide the depressed resting angle 218 (e.g., a depressed resting angle smaller than a resting angle of a conventional crochet device, such as a depressed angle between 0 to 20 degrees from a crocheting angle 228 in FIG. 2C). The depressed resting angle 218 may position the hook at a depressed position/angle so that reduced wrist motion may be used to lower the hook into a crocheting angle and/or maintain the hook at the crocheting angle during crocheting activity.

The grip anchor may comprise a curved portion configured to provide support for a first anchor finger of the user (e.g., a middle finger). The grip anchor may comprise a backside portion configured to provide support for a second anchor finger of the user (e.g., a ring finger). In this way, the grip anchor may create a pivot point 216 of the crochet device 212 near the grip anchor. In one example, the grip anchor may be configured to pivot the crochet device 212 at the pivot point 216 based upon support provided by the first anchor finger of the user against the curved portion of the grip anchor. In another example, the grip anchor may be configured to pivot the crochet device 212 at the pivot point 216 based upon additional support provided by the second anchor finger of the user against the backside portion of the grip anchor. Reduced wrist motion may be used to maneuver the crochet device 212 because the pivot point 216 is near the grip anchor (e.g., small wrist motion may translate into large positional change of the hook).

FIG. 2C illustrates an example 220 of a crochet device 222 held at a crocheting angle 228. The crochet device 222 may be held at the crocheting angle 228 while a wrist of a user is held in a flexed position 224. The crochet device 222 may have been placed into the crocheting angle 228 from a depressed resting angle (e.g., depressed resting angle 218 of FIG. 2B) with reduced wrist motion due to the crochet device 222 comprising a curved elongated shaft configured to create the depressed resting angle. Additionally, the crochet device 222 may comprise a grip anchor configured to create a pivot point 226 near the grip anchor, which may allow the user to place the crochet device 222 into the crocheting angle 228 with reduced wrist motion. The crochet device 222 may be controlled by the user using a relaxed grip (e.g., less finger pressure may be used in the relaxed grip in comparison with gripping conventional crochet devices, while still maintaining adequate control of the crochet device 222) because a first anchor finger and/or a second anchor finger may gently rest around the grip anchor to secure the crochet device 222, while non-anchor fingers may gently rest within a curvature of the curved elongated shaft.

Figure 3A:
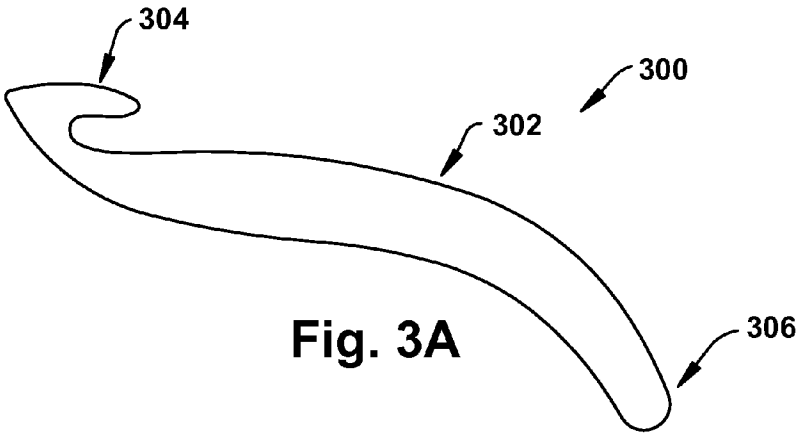
FIG. 3A is an illustration of an example of a crochet device comprising a curved elongated shaft.

FIG. 3A illustrates an example 300 of a crochet device. The crochet device may comprise a curved elongated shaft 302. The curved elongated shaft 302 may comprise a hook end coupled to a hook 304 used for crocheting material. The curved elongated shaft 302 may comprise a base end 306 configured to create a pivot point between a palm of a user and a first anchor finger of the user (e.g., pivot point 316 of FIG. 3B). In one example, the base end 306 may create the pivot point between the palm of the user resting on a top portion of the base end 306 and the first anchor finger resting under a bottom portion of the base end 306. In another example, the base end 306 may create the pivot point between the palm of the user resting on the top portion of the base end 306 and at least two anchor fingers resting under the bottom portion of the base end 306.

Figure 3B:
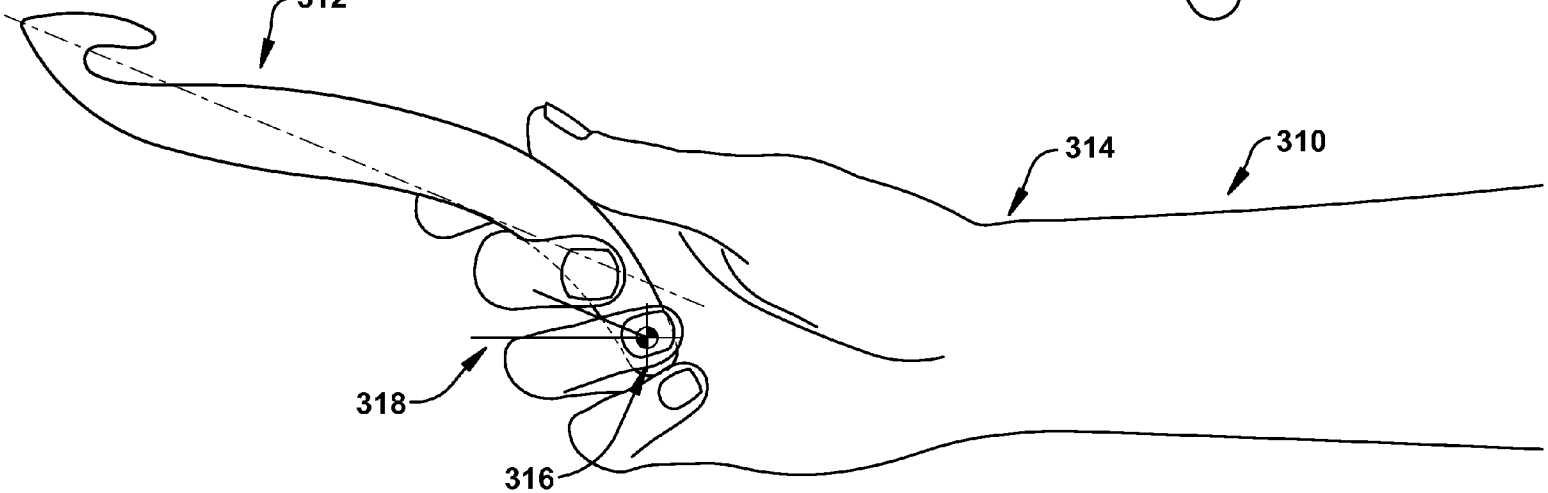
FIG. 3B is an illustration of an example of a crochet device comprising a curved elongated shaft, the crochet device held at a depressed resting angle.

The curved elongated shaft 302 may comprise a curvature configured to provide a depressed resting angle of the crochet device when held by the user at rest (e.g., depressed resting angle 318 of FIG. 3B). For example, the curvature may comprise an elevation change from the hook end to the base end 306 between about 0.5 inches and 2 inches, which may position the hook 304 at a depressed position/angle (e.g., a lower position/angle than convention crochet devices, such as a 0 to 20 degree angle between the depressed resting angle and a crocheting angle, as opposed to a 40 degree or more angle created by conventional crochet devices). It may be appreciated that the elevation change is not limited to between 0.5 inches and 2 inches, and that other elevation changes are contemplated herein. The depressed resting angle may be smaller than a resting angle of a conventional crochet device due to the curvature of the curved elongated shaft 302 placing the hook at a lower position/angle. Accordingly, reduce wrist motion may be used to maneuver the crochet device into a crocheting angle for crochet activity (e.g., crocheting angle 228 of FIG. 2C). The curvature may be configured to provide a low pressure resting position for one or more fingers of the user during crocheting activity, which may reduce finger tip pressure, hand fatigue, and/or pain (e.g., non-anchor fingers may gently rest along the curvature).

FIG. 3B illustrates an example 310 of a crochet device 312 held at a depressed resting angle 318. The crochet device 312 may be held at the depressed resting angle 318 while a wrist of a user is held in a resting position 314. The crochet device 312 may comprise a curved elongated shaft. The curved elongated shaft may comprise a hook end coupled to a hook used for crocheting material. The curved elongated shaft may comprise a base end configured to create a pivot point 316 near the base end. The pivot point 316 may allow the user to maneuver the crochet device 312 with reduced wrist motion (e.g., small wrist motion may translate into large positional change of the hook). The curved elongated shaft may comprise a curvature configured to provide the depressed resting angle 318 (e.g., the depressed resting angle 318 may be smaller than a resting angle of a conventional crochet device, such as a depressed angle between 0 to 20 degrees from a crocheting angle 228 in FIG. 2C). The depressed resting angle 318 may position the hook at a depressed position/angle so that reduced wrist motion may be used to lower the hook into a crocheting angle and/or maintain the hook in the crocheting angle during crocheting activity. The curvature may be configured to provide a low pressure resting position for one or more fingers of the user during crocheting activity, which may reduce finger tip pressure, hand fatigue, and/or pain (e.g., non-anchor fingers may gently rest along the curvature).

Figure 4A:
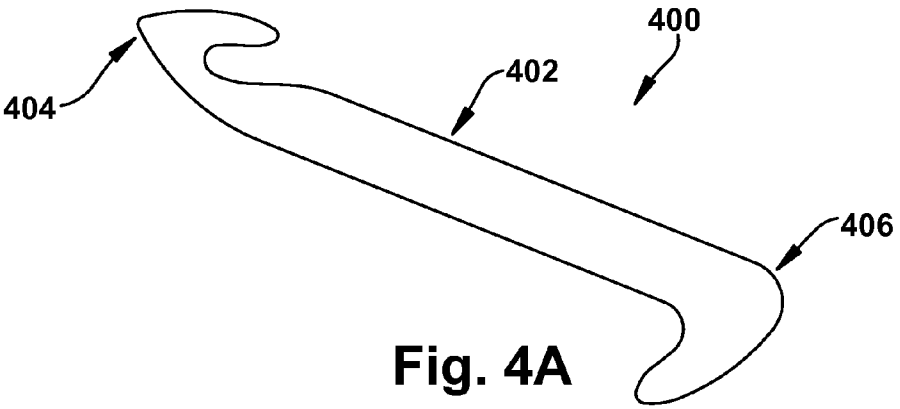
FIG. 4A is an illustration of an example of a crochet device comprising a grip anchor.

FIG. 4A illustrates an example 400 of a crochet device. The crochet device may comprise a shaft 402. The shaft 402 may comprise a hook end coupled to a hook 404 used for crocheting material. The shaft 402 may comprise a base end coupled to a grip anchor 406. In one example, the grip anchor 406 may extend at least half an inch from the base end of the shaft 402. It may be appreciated that the grip anchor 406 is not limited to extending at least half an inch from the base end, and that other lengths are contemplated herein (e.g., the grip anchor 406 may extend at least far enough to provide support for a first anchor finger of the user). The grip anchor 406 may comprise a curved portion configured to provide support for a first anchor finger of a user (e.g., a middle finger and/or any other finger of the user). The grip anchor 406 may comprise a backside portion configured to provide support for a second anchor finger of the user (e.g., a ring finger and/or any other finger of the user).

The grip anchor 406 may be configured to create a pivot point of the crochet device near the grip anchor 406. In one example, the grip anchor 406 may be configured to pivot the crochet device at the pivot point based upon support provided by the first anchor finger of the user against the curved portion of the grip anchor 406. In another example, the grip anchor 406 may be configured to pivot the crochet device at the pivot point based upon additional support provided by the second anchor finger of the user against the backside portion of the grip anchor 406. The crochet device may be controlled by the user with the first anchor finger and/or second anchor finger using a relaxed grip (e.g., less finger pressure, such as finger tip pressure, may be used in the relaxed grip in comparison with gripping conventional crochet devices, while still maintaining adequate control of the crochet device) because the first anchor finger and/or the second anchor finger may gently rest around the grip anchor 406 to secure the crochet device. Securing the crochet device near the grip anchor 406 may create a depressed resting angle for the crochet device (e.g., a 0 to 20 degree angle between the depressed resting angle and a crocheting angle of the crochet device). Reduced wrist motion may be used to maneuver the crochet device because the pivot point is near the grip anchor 406 (e.g., small wrist motion may translate into large positional change of the hook).

Figure 4B:
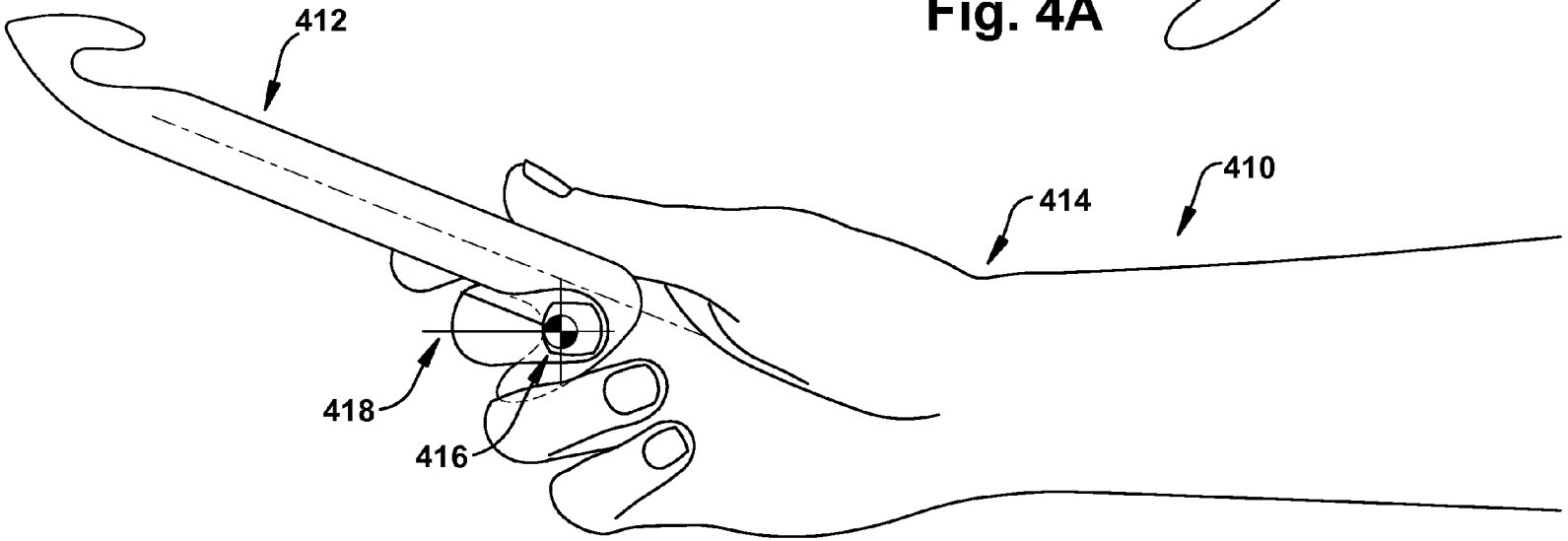
FIG. 4B is an illustration of an example of a crochet device comprising a grip anchor, the crochet device held at a depressed resting angle.

FIG. 4B illustrates an example 410 of a crochet device 412 held at a depressed resting angle 418. The crochet device 412 may be held at the depressed resting angle 418 while a wrist of a user is held in a resting position 414. The crochet device 412 may comprise a shaft. The shaft may comprise a hook end coupled to a hook used for crocheting material. The shaft may comprise a base end coupled to a grip anchor. The grip anchor may be configured to create a pivot point 416 for the crochet device 412 near the grip anchor. The grip anchor may be configured to pivot the crochet device 412 at the pivot point 416 based upon support provided by a first anchor finger and/or a second anchor finger of the user (e.g., a middle figure resting within a curved portion of the grip anchor and/or a ring finger resting upon a backside portion of the grip anchor). The crochet device 412 may be controlled by the first anchor finger and/or second anchor finger using a relaxed grip (e.g., the first and/or second anchor fingers may securely hold the crochet device 412 with reduced finger pressure). Securing the crochet device 412 near the grip anchor may create the depressed resting angle 418 for the crochet device (e.g., a 0 to 20 degree angle between the depressed resting angle and a crocheting angle of the crochet device). Reduced wrist motion may be used to maneuver the crochet device 412 because the pivot point 416 is near the grip anchor (e.g., small wrist motion may translate into large positional change of the hook).

Figure 5:
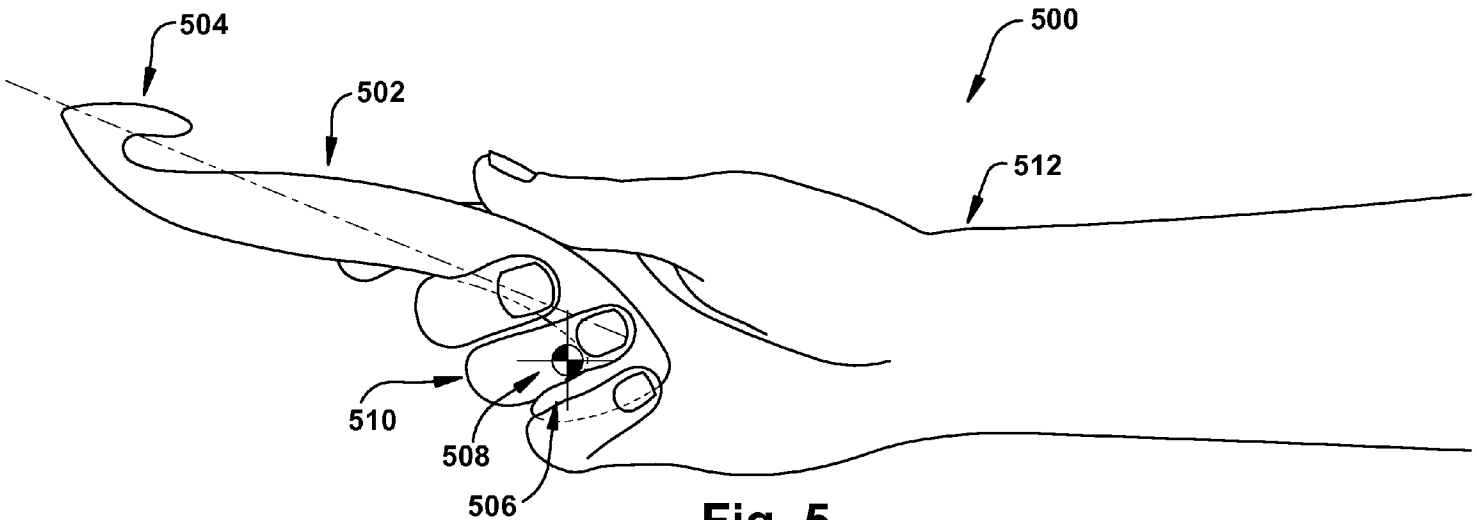
FIG. 5 is an illustration of an example of a crochet device comprising a curved elongated shaft and/or a grip anchor, the crochet device held at a depressed resting angle.

FIG. 5 illustrates an example 500 of a crochet device held at a depressed resting angle 510. The crochet device may be held at the depressed resting angle 510 while a wrist of a user is held in a resting position 512. The crochet device may comprise a curved elongated shaft 502. The curved elongated shaft 502 may comprise a hook end coupled to a hook 504 used for crocheting material. The curved elongated shaft 502 may comprise a base end coupled to a grip anchor 506. The curved elongated shaft 502 may comprise a curvature configured to provide a low pressure resting position for fingers of the user during crocheting activity. The curvature may be configured to provide the depressed resting angle 510 angle for the crochet device (e.g., a depressed resting angle smaller than a resting angle of a conventional crochet device when held at rest). The depressed resting angle 510 may position the hook 504 at a depressed position/angle so that reduced wrist motion may be used to lower the hook 504 into a crocheting angle and/or maintain the hook 504 at the crocheting angle during crocheting activity.

The grip anchor 506 may be configured to create a pivot point 508 for the crochet device near the grip anchor 506. The grip anchor 506 may be configured to pivot the crochet device at the pivot point 508 based upon support provided by a first anchor finger and/or a second anchor finger of the user (e.g., a middle figure resting within a curved portion of the grip anchor 506 and/or a ring finger resting upon a backside portion of the grip anchor 506). The crochet device may be securely held and/or controlled by the first anchor finger and/or second anchor finger using a relaxed grip (e.g., reduce finger pressure may be used to secure the crochet device in comparison with finger pressure and/or finger tip pressure used to secure conventional crochet devices). Reduced wrist motion may be used to maneuver the crochet device because the pivot point 508 is near the grip anchor 56 (e.g., small wrist motion may translate into large positional change of the hook 504).

Figure 6:
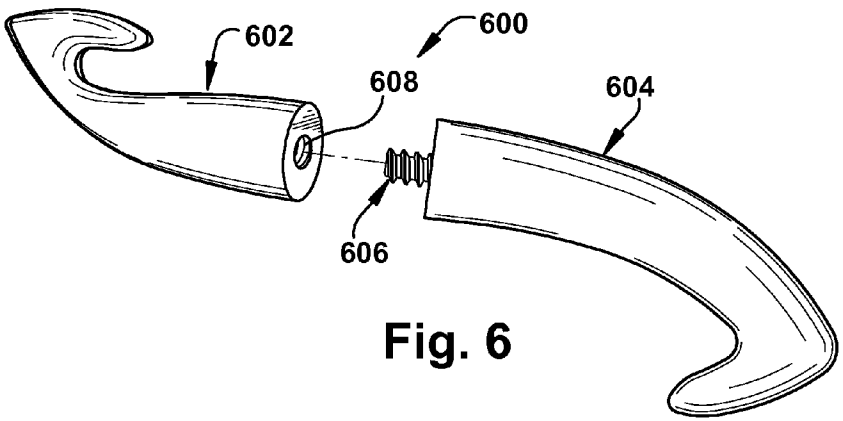
FIG. 6 is an illustration of an example of a crochet device comprising a curved elongated shaft and a grip anchor.

FIG. 6 illustrates an example 600 of a crochet device. The crochet device may comprise a curve elongated shaft 604. The curved elongated shaft 604 may comprise a base end coupled to a grip anchor. The curved elongated shaft 604 may comprise a hook end configured to attach to a hook 602. In particular, the hook end may comprise a shaft attachment connector 606. In one example, the shaft attachment connector 606 may comprise a male connector, such as a square fitting, a square fitting comprising a spring-loaded ball detent mechanism (e.g., similar to a socket to ratchet connection), and/or a wide variety of other male connectors suitable for securely connecting the curved elongated shaft 604 to the hook 602 during crochet activity. In another example, the shaft attachment connector 606 may comprise a female connector, such as a square hole, a square hole comprising a lock for a ball detent mechanism, and/or a wide variety of other female connectors suitable for securely connecting the curved elongated shaft 604 to the hook 602 during crochet activity.

The shaft attachment connector 606 may be configured to attach the curved elongated shaft 604 to a hook attachment connector 608 of the hook 602. In one example, the hook attachment connector 608 may comprise a female connector, such as a square hole, a square hole comprising a lock for a ball detent mechanism, and/or a wide variety of other female connectors suitable for securely connecting the hook 602 to the curved elongated shaft 604 during crochet activity. In another example, the hook attachment connector 608 may comprise a male connector, such as a square fitting, a square fitting comprising a spring-loaded ball detent mechanism (e.g., similar to a socket to ratchet connection), and/or a wide variety of other male connectors suitable for securely connecting the hook 602 to the curved elongated shaft 604 during crochet activity. In this way, the shaft attachment connector 606 and the hook attachment connector 608 may be configured to attach to one another so that the hook 602 may be securely attached to the curved elongated shaft 604 during crochet activity (e.g., a female connector attached to the curved elongated shaft 602 may attach to a male connector attached to the hook 602).

Various hooks may be attached to the curved elongated shaft 604 using the shaft attachment connector 606 and/or the hook attachment connector 608. Such hooks may vary in size, length, hook curvature, configuration, and/or other features. Similarly, variations of the curved elongated shaft 604 may be attached to the hook 602 using the shaft attachment connector 606 and/or the hook attachment connector 608. Such variations may correspond to variations in size, length, curvature, elevation change, shape, configuration, and/or other features, such as variations to the grip anchor (e.g., size, curvature, shape, etc.).

In addition to being configured for ergonomic comfort, it is contemplated that the present invention crochet devices may be made in different sizes, lengths, dimensions, curvatures, and/or materials.

What is claimed is:

1. A crochet device, comprising:

an elongated shaft defining a planar shaft curve, said shaft curve lying within a first plane, said shaft having,
- a hook end having a hook,
  - defining a planar hook curve lying within the first plane, and
  - being adapted to manipulate crochetable material to form loops, stitches, or patterns; and
- a base end opposite said hook end, said base end having
  - a grip anchor, said grip anchor,
  - defining a planar grip anchor curve having,
    - a concave arcuate surface
      - adapted to accept a first finger of a first hand of an associated user being inserted therethrough, and
    - a convex arcuate surface
      - facing oppositely from said concave arcuate surface, and
      - having a set of subsurfaces
      - having a first subsurface proximate to the hook end and a second subsurface distal from said hook end, wherein
      - the first subsurface and the second subsurface are adapted to be simultaneously grasped between a second finger of the first hand and a third finger of the first hand.

2. The crocheting device of claim 1, wherein said planar grip anchor curve lies with said first plane.

3. The crocheting device of claim 2, wherein said concave arcuate surface defines a first arc center point.

4. The crocheting device of claim 3, wherein said convex arcuate surface defines a second arc center point coincident with said first arc center point.

5. The crocheting device of claim 3, wherein said concave arcuate surface is adapted to simultaneously contact and extend more than a third of the distance around the first finger.

6. The crocheting device of claim 4, wherein said concave arcuate surface is adapted to simultaneously contact and extend more than half of the distance around the first finger.

7. The crocheting device of claim 6, wherein said convex arcuate surface defines a second arc center point coincident with said first arc center point.

8. The crocheting device of claim 7, wherein said grip anchor extends at least half an inch from the base end.

9. The crocheting device of claim 8, wherein said shaft is selectively separable into a first section having the hook end and a section having the base end.

10. The crocheting device of claim 6, wherein the first section and the section each have one part of a connector set, the connector set being a spring ball detent mechanism having a hook attachment connector and a shaft attachment connector.

* * * * *